United States Patent [19]

Hein

[11] 4,239,464

[45] Dec. 16, 1980

[54] BLOOD PUMP

[75] Inventor: Lars Hein, Horsholm, Denmark

[73] Assignee: Polystan A/S, Herlev, Denmark

[21] Appl. No.: 950,116

[22] Filed: Oct. 10, 1978

[30] Foreign Application Priority Data

Oct. 14, 1977 [DK] Denmark ..... 4574/77

[51] Int. Cl.[3] ..... F04B 43/14

[52] U.S. Cl. ..... 417/474; 417/478; 417/510; 251/7; 251/8

[58] Field of Search ..... 417/479, 478, 474, 510; 251/4, 7, 8

[56] References Cited

U.S. PATENT DOCUMENTS

| | | | |
|---|---|---|---|
| 1,988,624 | 1/1935 | Kipp | 417/479 X |
| 2,017,974 | 10/1935 | Kastner | 417/510 X |
| 2,105,200 | 1/1938 | Phelps | 417/474 |
| 2,393,838 | 1/1946 | Tarbox | 417/474 |
| 2,412,397 | 12/1946 | Harper | 417/474 |
| 2,695,567 | 11/1954 | Harvey | 417/474 X |
| 3,359,910 | 12/1967 | Latham | 417/478 X |
| 3,489,097 | 1/1970 | Gemeinhardt | 417/478 |
| 3,606,596 | 9/1971 | Edwards | 417/479 |
| 3,658,445 | 4/1972 | Pulman et al. | 417/474 |
| 3,720,485 | 3/1973 | Holman | 417/479 X |
| 3,811,800 | 5/1974 | Shill | 417/479 X |
| 3,918,675 | 11/1975 | Forberg | 251/4 X |
| 4,131,399 | 12/1978 | Calvet | 417/477 |

*Primary Examiner*—Richard E. Gluck
*Attorney, Agent, or Firm*—Ira C. Edell

[57] ABSTRACT

Blood pump comprising an inlet valve, an outlet valve, and a displacement chamber being portions of a common flexible tubing being squeezable between fixed wall means and two spaced, movable valve plungers and a displacement plunger arranged on the portion of the tubing therebetween, wherein the valve plungers in the flow direction of the tubing have a dimension exceeding 5 mm and that in the tubing, with the valve plungers in closed position, a slot is left with a height less than 0.5 mm.

4 Claims, 5 Drawing Figures

BLOOD PUMP

The invention relates to a pump in which an inlet valve, an outlet valve, and a chamber with a variable volume are formed by portions of a flexible tubing.

In certain types of surgery the patient's heart and lung functions are replaced by machines inserted in an extracorporeal circulation, in which the patient's blood is bypassed from the body and, after oxygenation, returned to the patient. The duration of the surgical operations are limited by the damage to the blood cells, the hemolysis, and by the formation of microembolies, i.e. microscopic bubbles in the blood. These circumstances limit the period in which an extracorporeal circulation may be used to 5–10 hours.

Normally pumps of the type in which a flexible tube is compressed between a roller and a curved wall are used, in which pumps the roller is mounted on a head rotating around an axis common with that of the curved wall. These pumps are known to produce considerable hemolysis, which seems to be related with the constructional principles of the pump.

A further disadvantage of these normally used pumps is that they produce a constant flow which is a deviation from the physiologically correct conditions.

Pumps having an inlet valve, an outlet valve, and a chamber with a variable volume are, however, in harmony with the physiological conditions and have been used as blood pumps. The chamber with variable volume is not liable to give hemolysis, but the valves are extremely problematic either because of a contact between the valve and its seat or because of the fact that a ligation of the path of flow is liable to produce high shear forces in the liquid.

The object of the invention is to provide a blood pump in which the hemolysis is minimized and in which the stresses on the flexible tubing are small in order to extend the period in which an extracorporeal circulation may be used.

This object is accomplished in a blood pump comprising an inlet valve, an outlet valve, and a displacement chamber with a variable volume being portions of a common flexible tubing being squeezable between fixed wall means and two spaced and movable valve plungers arranged therebetween. The pump is characterized in that the valve plungers in the longitudinal direction of the tubing have a dimension of at least 5 mm and in that, with the valve plungers in closed position, a slot is left with a height less than 0.5 mm.

The construction of the valves with a narrow slot of a certain length will result in some leakage. The shear forces in the liquid, however, will be reduced to values below the safety limits for hemolysis. Further the tubing is much less stressed, which will reduce the risk of cracking.

Figure 1:
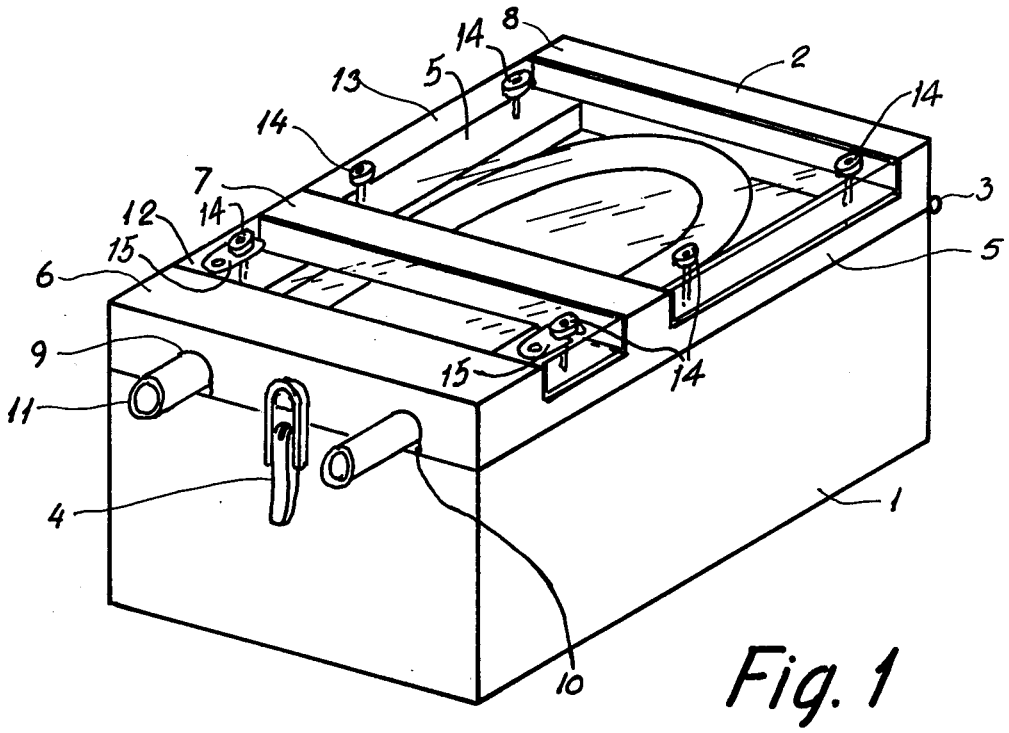
Figure 3:
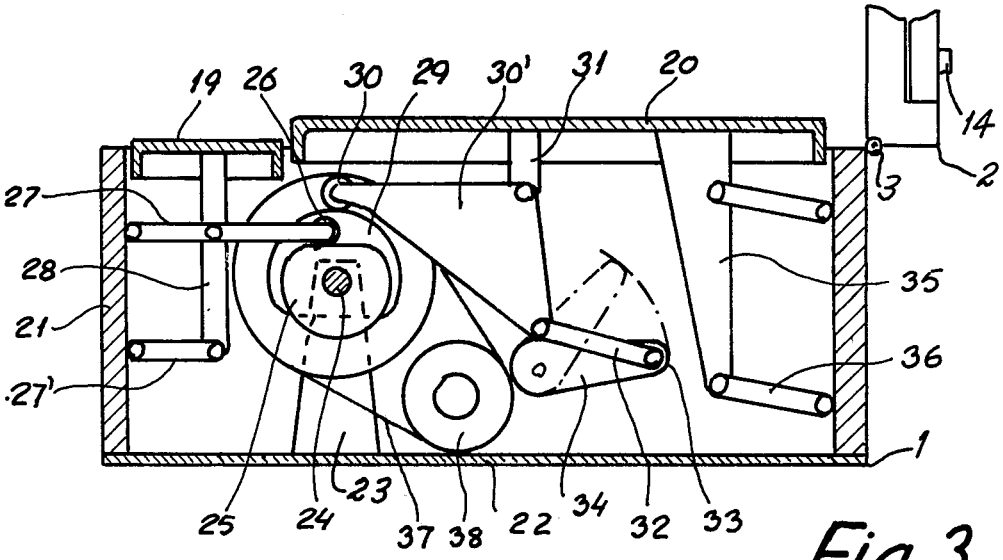
Figures 2, 4, 5:
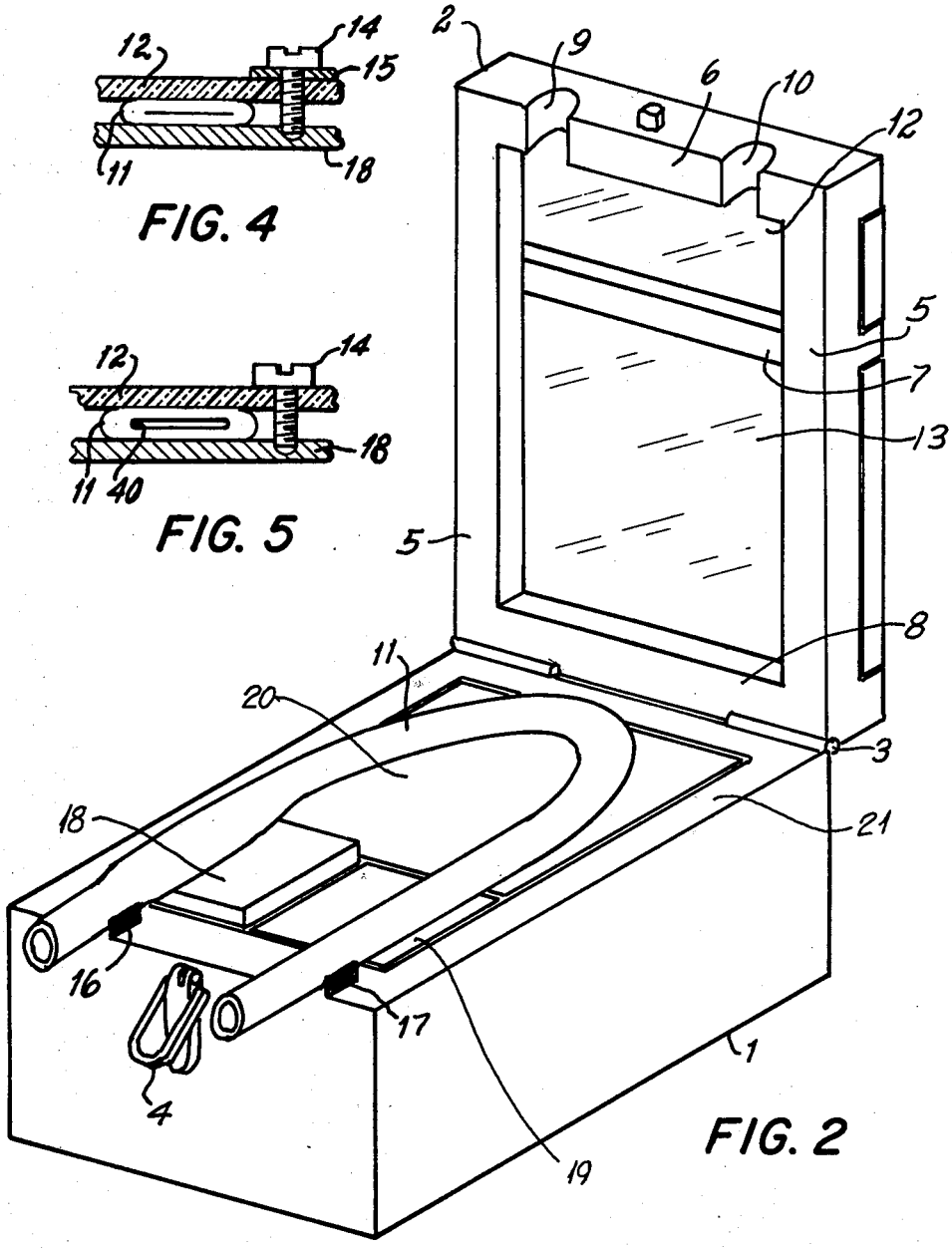

The invention will be described in details with reference to the drawings in which FIG. 1 shows the pump in perspective, FIG. 2 shows the pump in perspective with the lid in open position, ready for insertion of the tubing, FIG. 3 a schematic longitudinal section through the pump with the lid open and partly cut away, FIG. 4 is a schematic sectional view showing full constriction of the pump tube, and FIG. 5 is a schematic sectional view showing a flow slot formed in a partially restricted tube.

The pump according to the invention is shown in perspective in FIG. 1. A housing 1 is provided with a lid 2, being connected to the housing by means of a hinge 3. Opposite the hinge 3 the lid may be held in a closed position by means of a locking device 4. The lid 2 has a frame comprising longitudinal members 5 and beams 6, 7, and 8. The beam 6 placed opposite the hinge has two notches 9, 10 corresponding to the cross section of a tube 11, in which the pump is to provide a flow of liquid. The notches are adapted to the tubing in such a way that the tubing is held firmly in the lid by means of the locking device 4.

Between the beams 6 and 7 in the lid 2 a transparent plate 12 is mounted, for example from limpid acryl, and between the beams 7 and 8 another plate 13, also made from transparent material, is mounted. The plates 12, 13 are held to the members 5 by means of adjusting screws 14. Between the members 5 and the plates 12,13 resilient fillers are fitted, pressing the plates in a direction away from the members. Under the heads of the two screws 14 holding the plate 12 two slidable elements 15 are provided, the function of which will be explained below. The lower surface of the plates 12, 13 is substantially level with the underside of the beam 7 and the deepest part of the notches 9, 10.

In FIG. 2 the pump is shown with the lid 2 opened. The tubing has been placed as a bight and is to be pressed against the notches 9, 10 by means of tubeholders 16, 17 when the lid is closed. The tops of the three plungers 18, 19, 20 cover the main part of the top surface of the housing 1. The plungers 18, 19 are comparatively small and cover only half the width of the housing while the plunger 20, which is the extruder plunger, has substantially the same width as the housing inside its walls 2. The plungers 18, 19, 20 are, in their lowest positions, approximately level with the upper edge of the walls 21. The plunger 18 controls the outlet valve function and is shown in its upper position. The plunger 20 provides the displacement function, and the plunger 19 controls the inlet valve function of the pump.

The operation of the pump is described in the following:

When the tubing 11 is placed as shown in FIG. 2 (an indication may be drawn on the upper surface of the housing to show how the tubing is to be arranged) the lid is closed as shown in FIG. 1. The tubing then will be held firmly in the notches 9, 10 in the lid. As the plunger 18 is in its upper position, the tubing 11 will be squeezed against a porton of the plate 12 at the plunger 18. When the pump is started, the displacement plunger 20 will move upwards and press the blood in the tubing away from the tube portion residing above the displacement plunger, thereby squeezing the tube against the plate 13. After this, the plunger 19 is moved upwards squeezing the tube portion residing above the plunger 19 against another portion of plate 12. Thereafter the plunger 18 and the displacement plunger 20 are lowered in order to fill again the tubing with blood. After the plunger 18 has been moved upwards again and the plunger 19 has been lowered, a new cyclus may start.

In order to avoid damage to the blood cells, an adjustment of the pump before starting is important. Owing to the transparency of the plates 12, 13 and the red color of the blood, it is easy to see when the tubing is totally squeezed as in FIG. 4. With each of the plungers in its upper position, an adjustment of the screws 14 is made until total occlusion is just obtained. This adjustment is done at the plate 12 with the slidable elements 15 inserted under the heads of the screws. When the adjustment has been made, the elements 15 are displaced from below the screws as shown in FIG. 5, whereby a slot 40 is provided in the tubing of the same height as the thickness of the slidable elements in other words, the previously occluded tube is opened slightly to form a shallow passage or slot 40. The plate 13 is lifted slightly by turning backwards the screws a predetermined angle.

Owing to the width of the plungers, the slot 40 in the portions of the tubing forming inlet and outlet valves will have such a length that only a small part of the blood will flow backwards through the slot 40 with the pressure conditions prevailing under surgical conditions, and the difference in pressure will be distributed over such a great length that the shear forces in the liquid nowhere will exceed the limit at which the blood coagulating cells are activated. in practice the height of the slot 40 in the squeezed tubing is below 0.5 mm. With a height of the slot 40 of 0.03 mm, a length (in the direction of the tubing) of the slot 40 of 6 cm at the pressures prevailing during surgical operations will give shear forces of approximately half the value considered critical with respect to hemolysis.

The mechanical construction of the elements providing the movement of the plungers is shown schematically in FIG. 3, in which a section through the housing is shown. The housing is defined of the sides of the walls 21, at the top by the plungers 18, 19, and 20, below by a bottom 22. On the bottom 22 brackets 23 are mounted with bearings for a camshaft 24. The camshaft has three cams, i.e. one for each of the plungers. The cam disc 25, providing the movement of the valve plunger 19, acts on a cam gear 26 on the end of a lever 27. This lever is connected with a rod 28 on which the plunger is mounted. The lever 27 is further hinged on the inside of the wall 21. In order to provide a parallel movement, a further lever 27' is arranged between the rod 28 and the wall 21.

The displacement plunger 20 is provided with a mechanism for adjusting the stroke. A number of mechanisms for that purpose are known and the following description is an example only of a suited mechanism. The cam disc 29 acts on a cam gear 30 on one corner of a triangular plate 30'. Another corner is connected with a bracket 31 on the extruder plunger 20. The third corner is, by means of a connecting rod, connected with the free end 33 of a pivotable lever 34, pivoting around an axle with a bearing in the wall 21, the axis of which passes through the fixing point on the triangular plate of the connecting rod. The plunger 20 is provided with a parallel linkage by means of the bracket 35 and the rods 36.

The camshaft 24 is driven by means of a toothed belt 37 from an electric motor 38 mounted on the bottom 22. By regulating the numbers of revolutions per minute of the motor, the number of strokes per minute may be changed, and it is possible to adjust this number in accordance with the pulse of the patient being subject to the surgical operation in the heart or lungs.

The described pump is an embodiment of the pump according to the invention. It is possible to construct the pump in such a way that the tubing runs straight or in another shape across the top of the plungers. The plates against which the tubing is squeezed may be a number of separate parts being hinged or fixed separately.

The adjustment may be provided in an adjustable pressure plate on the top of the plungers, possibly by means of screws being accessible through holes in the plates forming the fixed wall against which the tubing is squeezed. The movement of the plungers may be performed in other ways than by cams, for example by crankshafts or hydraulically or electromagnetically.

What is claimed is:

1. A blood pump comprising:

an elongated flexible tube defining a flow path for the blood;

inlet valve means for selectively restricting flow through said tube at a first longitudinal position along said tube, said inlet valve means comprising a first flat-surfaced plunger valve and a first fixed flat wall portion disposed in movable spaced relation on opposite sides of said tube at said first position;

outlet valve means for selectively restricting flow through said tube at a second longitudinal position along said tube, said outlet valve means comprising a second flat-surfaced plunger valve and a second fixed flat wall portion disposed in movable spaced relation on opposite sides of said tube at said second position;

displacement means comprising a third plunger valve and a third fixed wall portion disposed in movable spaced relation on opposite sides of said tube at a third position intermediate said first and second positions;

actuator means for selectively actuating said first, second and third plungers for movement toward and away from said first, second and third wall portions, respectively, in a prescribed sequence so as to sequentially restrict said tube at said first, second and third positions; and adjustment means for limiting the restriction of said flow tube at least at one of said first and second positions by adjusting said spaced relation of at least one of said first and second fixed flat wall section such that a passage for blood flow through said tube is provided when the tube is in its most restricted condition at said at least one position, said passage having a length in the flow direction of at least 5 mm and having a restriction height of less than 0.5 mm.

2. The blood pump according to claim 1 wherein said adjustment means provides said passage to limit blood flow through said tube at both said first and second positions.

3. The blood pump according to claim 2 wherein the tube extends longitudinally along the flat surface of each of said first and second plunger valves a distance between 5 mm and 60 mm, and wherein the height of said passage is between 0.3 mm and 0.5 mm.

4. The blood pump according to claims 1, 2 or 3 wherein said adjustment means comprises adjustment screw means, including a screw head for adjustably spacing said first plunger valve from said first wall portion, and a flat slidable element removably interposed between said screw head and said first wall portion, whereby tightening of said adjustment screw means to achieve complete restriction of said tube and then removal of said slidable element from between said screw head and said first wall portion reduces the restriction to form said passage.

* * * * *